United States Patent [19]

Czech et al.

[11] 4,186,358

[45] Jan. 29, 1980

[54] ADJUSTABLE COAXIAL LINE-TO-MICROSTRIP LINE TRANSITION

[75] Inventors: Johannes Czech, Backnang; Peter Dörntlein, Dreieich, both of Fed. Rep. of Germany

[73] Assignee: Licentia Patent-Verwaltung-G.m.b.H., Frankfurt, Fed. Rep. of Germany

[21] Appl. No.: 867,034

[22] Filed: Jan. 5, 1978

[30] Foreign Application Priority Data

Jan. 5, 1977 [DE] Fed. Rep. of Germany ..... 2700231

[51] Int. Cl.[2] ..... H01P 5/08

[52] U.S. Cl. ..... 333/33; 333/238

[58] Field of Search ..... 333/21 R, 33, 34, 35, 333/84 M

[56] References Cited

U.S. PATENT DOCUMENTS

| | | | |
|---|---|---|---|
| 3,201,721 | 8/1965 | Voelcker | 333/33 |
| 3,622,915 | 11/1971 | Davo | 333/34 |

OTHER PUBLICATIONS

England, *A Coaxial to Microstrip Transition*, IEEE Trans. on MTT, Jan. 1976, pp. 47, 48.

*Primary Examiner*—Paul L. Gensler

*Attorney, Agent, or Firm*—Spencer & Kaye

[57] ABSTRACT

A transition device for connecting a coaxial cable to an integrated microwave circuit (MIC) composed of planar lines disposed on a substrate, the device being composed of a coaxial connector having a protruding inner conductor, a tuning screw disposed to form a variable capacitor with the protruding conductor of the coaxial connector and arranged to be adjusted to control the electrical parameters of the device, an intermediate dielectric carrier carrying a planar intermediate line connected to the inner conductor of the connector, the intermediate carrier forming a fixed unit with the coaxial connector and being disposed between the connector and the (MIC) substrate, a housing supporting the fixed unit and the substrate, and two metal bands connecting together the planar intermediate line and the planar line of the microwave circuit and the bottom metallization.

11 Claims, 5 Drawing Figures

20° C

200° C

20° C 3
4
6a
7
9
5
A
A
8
5'
6b
6
6a

ADJUSTABLE COAXIAL LINE-TO-MICROSTRIP LINE TRANSITION

BACKGROUND OF THE INVENTION

The present invention relates to a coaxial-to-microstrip transition connector which can be adjusted by means of a tuning screw, the transition being provided between a coaxial plug-in connection and an integrated microwave circuit disposed on a substrate.

The transition from a coaxial system, for example a plug, to planar lines as exemplified by an integrated microwave circuit on a substrate, presents considerable difficulties with regard to mechanical stability, electrical matching, thermal stresses. With very high frequencies, for example in the range above 1 GHz, in particular, imperfections are difficult to avoid.

A partial solution for compensating for imperfections in coaxial-to-microstrip transition connectors is described in the *IEEE Transactions on Microwave Theory and Techniques,* January 1976, page 48 (FIG. 5). This arrangement, however, is not suitable for compensating imperfection tolerances resulting from manufacture. Moreover, the small contact surface, which is determined by the length of the inner conductor, does not meet existing stability requirements.

SUMMARY OF THE INVENTION

It is an object of the present invention to provide a connection, or transition, between a coaxial cable and a microstrip line which, for frequencies of up to 18 GHz has a low reflection factor; good mechanical stability connection between the inner coaxial conductor and the microstrip line; the capability of absorbing the effects of varying thermal expansions between substrate and housing in a temperature range from −40° C. to +80° C.; and reliably reproducible operating characteristics.

This and other objects are achieved, according to the present invention, by arranging an intermediate microstrip carrier provided with a planar intermediate conductor strip between a coaxial plug connector and the substrate carrying the microwave integrated circuit, the intermediate carrier forming a fixed unit with the plug connector and with a housing holding the substrate, and by constituting the electrical connection between the planar intermediate line and the substrate which connection is associated with the inner conductor, of a looped metal band, the coaxial plug having a setting screw which forms a variable capacitance with the inner conductor of the plug connector and air being the dielectric of that medium.

It is advisable to use a substrate made of an aluminum oxide ceramic, or of sapphire, while the intermediate carrier is advantageously a polyfluorethylene with homogeneously distributed glass fiber reinforcement. It is advisable to associate with the metal band, which acts as the inner conductor between the intermediate carrier and the substrate, a second metal band having about 10 times the width of the inner conductor to act as the outer conductor, and to make the first metal band of gold and give it a loop provided with a loop arrangement form corresponding to the thermal expansion which can occur between the parts connected together by the band.

With such an arrangement, the objects of the invention, and particularly reproducibility, can be realized with simple means.

FIGS. *2a, 2b* and *2c* are generalized views of successive individual steps in the formation of the inner conductor connection between the intermediate conductor and the substrate.

Figure 3:
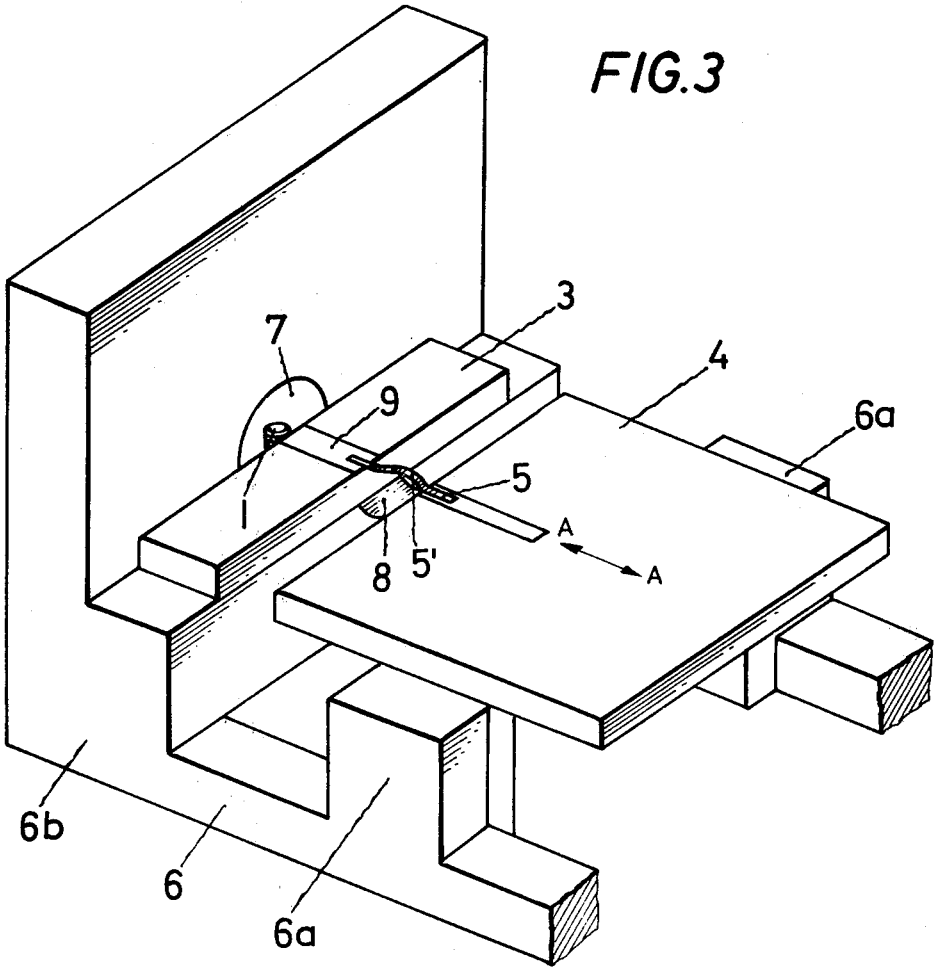

FIG. 3 is a perspective view of a complete arrangement according to a preferred embodiment of the invention.

DESCRIPTION OF THE PREFERRED EMBODIMENTS

Figure 1:
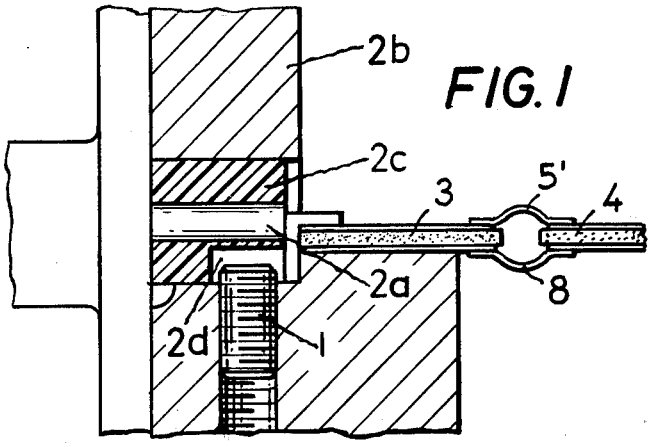
FIG. 1 is a cross-sectional, generalized view of an embodiment of the invention, showing the arrangement of the tuning screw in its position with respect to the inner conductor of a coaxial plug connector.
Figure 2A:
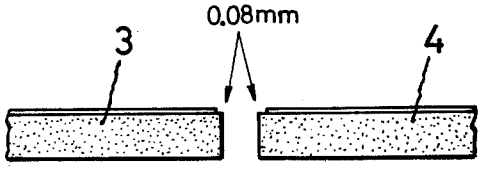
Figure 2B:
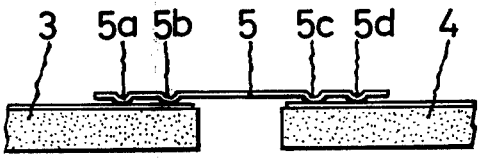
Figure 2C:
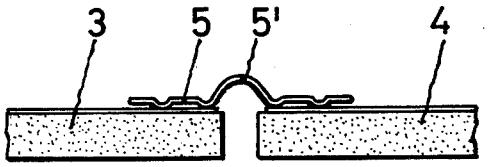

FIG. 1 illustrates a transition connector according to the invention provided with a tuning screw 1, shown in position with respect to the inner conductor *2a* of a coaxial plug connector for adjusting the operating characteristics of the transition. The coaxial part includes the inner conductor *2a,* a housing *2b* constituting the outer conductor and an insulator forming a dielectric medium *2c* which is provided with a recess *2d* over part of its coaxial cross section, the tuning screw 1 for setting the most favorable capacitance value between housing *2b* and inner conductor *2a* engaging in this recess *2d.*

FIGS. *2a, 2b* and *2c* show three steps in the formation of a connection loop for compensating thermal expansion effects between intermediate carrier 3 and substrate 4, separated, for example, by an air gap of 0.08 mm at an average operating temperature of 20° C., as shown in FIG. *2a,* both carrier 3 and substrate 4 being mounted on an aluminum base plate.

The formation of the loop itself can be accomplished in two ways:

1. The entire arrangement can be heated to a temperature of 200° C., as shown in FIG. *2b,* and at this temperature the metal band 5 is bonded at respective ends to intermediate carrier 3 and substrate 4 and connection to carrier 3 being at points *5a* and *5b* and connection to substrate 4 being at points *5c* and *5d.* Due to the increase in temperature, the gap becomes wider and after application of the metal band 5 this arrangement is cooled back to 20° C. This cooling re-establishes the normal spacing of 0.08 mm as shown in FIG. *2c.* Due to this reduction in the spacing, metal band 5 will curve into a loop 5'. This temperature difference between 20° C. and 200° C. includes all temperatures occurring in practice so that sufficient flexibility is assured.

2. If it is not possible to employ a temperature of 200° C. to form the loop, i.e. if, for example, a bonding process employing lower temperatures is employed, the resulting reduction in the height of the loop must be compensated by preshaping the metal band at 20° C. by means of suitable tools.

FIG. 3 shows the entire arrangement of an embodiment of the invention in a perspective view. In an angular housing 6, the substrate 4 is fixed at both sides to supporting blocks *6a.* This housing 6 is preferably made of aluminum. The angled frontal face of the housing has an inwardly directed extension *6b,* on which rests the intermediate carrier 3. At the front of the housing 6 there is also a passage 7 to accommodate the coaxial plug connector. The coaxial connector is not shown, but there is shown the tuning screw 1 which forms a variable capacitance with the inner conductor of the coaxial plug connector.

The metal band 5 and its loop 5', which acts as the inner conductor, can be seen between substrate 4 and intermediate carrier 3. At the side facing the coaxial plug, this metal band 5 is bonded to the associated planar intermediate line 9. A second associated metal band 8 which connects the outer conductor of the coaxial lines to the microstrip ground plane can also be seen between and beneath the intermediate carrier 3 and the substrate 4. The movements of substrate 4 relative to carrier 3 upon changes in temperature is indicated by the arrows A. The planar intermediate line 9 connects the metal band 5 with the inner conductor 2*a* of the coaxial plug-in connection.

The individual conductor widths are approximately as follows:

Conductor width on the substrate 4, i.e. the MIC line: 0.6 mm (size of substrate 1 inch by 1 inch.

conductor width on the intermediate carrier 3, i.e. the planar intermediate line: 1.3 mm;

Metal band 5 acting as inner conductor: 0.5 mm in width with a loop height, due to heat shrinkage from 200° to 20° of about 1 mm; and Second metal band 8 acting as outer conductor: 5 mm is width.

It will be understood that the above description of the present invention is susceptible to various modifications, changes and adaptations, and the same are intended to be comprehended within the meaning and range of equivalents of the appended claims.

What is claimed is:

1. A transition device for connecting a coaxial cable to a planar line of an integrated microwave circuit disposed on a substrate, said device comprising: a coaxial plug connector terminating the coaxial cable and having a plug member connected to an inner conductor of the coaxial cable; a tuning screw arranged to be adjusted to control the electrical parameters of said device; an intermediate carrier carrying a planar intermediate line connected to said plug member of said connector, said intermediate carrier forming a fixed unit with said plug connector and being spaced from said substrate by a gap; a housing supporting said fixed unit and said substrate; and a metal band connecting together said planar intermediate line and said planar line of said microwave circuit thereby bridging said gap, said metal band compensating for the effects of thermal expansion of said substrate relative to said intermediate carrier.

2. An arrangement as defined in claim 1 wherein said tuning screw forms a variable capacitance with said plug member of said connector.

3. An arrangement as defined in claim 2 wherein said tuning screw is separated from said plug member by a mass of air constituting the dielectric medium of said capacitance.

4. An arrangement as defined in claim 1 wherein said substrate is made of an aluminum oxide ceramic.

5. An arrangement as defined in claim 1 wherein said substrate is made of sapphire.

6. An arrangement as defined in claim 1 wherein said intermediate carrier is made of a dielectric material having a low dielectric constant.

7. An arrangement as defined in claim 6 wherein the dielectric material of said substrate is polyfluoroethylene containing homogeneously distributed glass fiber reinforcement.

8. An arrangement as defined in claim 1 further comprising a second metal band associated with said first recited metal band, said second metal band forming the outer conductor connection between said intermediate carrier and said substrate and having about 10 times the width of said first recited band.

9. An arrangement as defined in claim 1 wherein said metal band is made of gold.

10. An arrangement as defined in claim 1 wherein said metal band has a loop portion dimensioned to provide for thermal expansion movements between said intermediate carrier and said substrate.

11. An arrangement as defined in claim 1 wherein said coaxial plug connector is provided with a housing and has a recess therein, said tuning screw projecting into said recess and being adjustable to vary the capacitance between said plug member and the housing of said coaxial plug connector.

* * * * *